United States Patent [19]

Rudell et al.

[11] Patent Number: 4,813,680

[45] Date of Patent: Mar. 21, 1989

[54] GAME WITH LIQUID SOLUTION RELEASE DEVICE

[76] Inventors: Elliot A. Rudell, 2215 W. 237th St., Torrance, Calif. 90501; George Foster, 2700 Panorama Dr., Signal Hill, Calif. 90806

[21] Appl. No.: 85,560

[22] Filed: Aug. 17, 1987

[51] Int. Cl.[4] ..... A63F 3/00; A63F 5/00

[52] U.S. Cl. ..... 273/249; 273/138 R

[58] Field of Search ..... 273/138 R, 139, 249

[56] References Cited

U.S. PATENT DOCUMENTS

| | | | |
|---|---|---|---|
| 613,414 | 11/1898 | Harrison et al. | 273/138 R |
| 2,915,221 | 12/1959 | Dillon | 273/138 R |
| 3,674,275 | 7/1972 | Samson | 273/138 R |
| 4,113,259 | 9/1978 | Sands | 273/249 X |

*Primary Examiner*—Anton O. Oechsle

*Attorney, Agent, or Firm*—Plante Strauss Vanderburgh

[57] ABSTRACT

This invention is a game and a head piece for the game. The game is played by any number of players who take alternate turns wearing the head piece which is a hat-like device, that supports a container of water. Positioned in the base of the container are a number of identical removable pegs. The removal of one particular peg will release the water down upon the wearer's head. All the pegs are identical so the wearer does not know just which peg will activate the water flow. The wearer is rewarded one point for each peg he has removed without getting wet. The game is played in a series of rounds wherein each player takes a turn wearing the hat-like device and a game is won after one player achieves a predetermined score. The game score is kept on a score mat upon which each player has a movable token.

17 Claims, 3 Drawing Sheets

GAME WITH LIQUID SOLUTION RELEASE DEVICE

BACKGROUND OF THE INVENTION

1. Field of the Invention

The invention relates to activity games, and more particularly to a game wherein players alternate turns wearing a device that contains a liquid which is released by the removal or repositioning of one of several identical rods.

2. Description of the Prior Art

As used herein, a game is defined as any specific amusement or sport involving physical or mental competition under specific rules. A toy, by comparison, is an article to play with, especially a plaything for children.

Action games wherein people actively participate with their bodies are well known. The most popular game is called "TWISTER" and is marketed by Milton Bradley Company. That game requires one or two players to touch colored squares on a vinyl mat.

Rules-based, physical action games involving liquid, such as water, are rare. Filling latex balloons with water and throwing them at one another is common, outdoor summer pastime for children. Games like water polo, played in a pool, are also common.

There are several outdoor water activity toys that offer unstructured, non-rule, non-competitive play. A water slide toy is marketed by Wham-O Manufacturing and called and called SLIP N SLIDE. This toy consists of a long vinyl mat that is kept wet by a garden hose. Children run up to, and then slide down, the slick, wet vinyl surface. Wham-O also markets a novelty sprinkler that children can run through. This toy is called FUN FOUNTAIN, and comprises a clown head base that attaches to a graden hose. The stream of water is directed upward through the head, raising the clown's hat about five feet in the air, and then cascading the stream of water down on the children. This toy has no competitive rules play, nor is their any gaming element.

To our knowledge, it has never been known to use a liquid solution release device as described herein to provide a thrilling consequence to a child's game.

SUMMARY OF THE INVENTION

This invention is a game which is played by any number of players who take alternate turns wearing a head piece, e.g., a hat-like device, that supports a liquid-holding container. Positioned in the base of the liquid-holding container are a number of identical, removable pegs. The removal of one particular peg will release the water down upon the wearer's head. All the pegs are identical so the wearer does not know just which peg will activate the water flow. The wearer is rewarded one point for each peg he has removed without getting wet. The game is played in a series of rounds wherein each player takes a turn wearing the hat-like device and a game is won after one player achieves a predetermined score. The game score is kept on a score mat upon which each player has a movable token.

BRIEF DESCRIPTION OF THE DRAWINGS

The invention will be described with reference to the Figures of which.

DESCRIPTION OF THE PREFERRED EMBODIMENT

Figure 1:
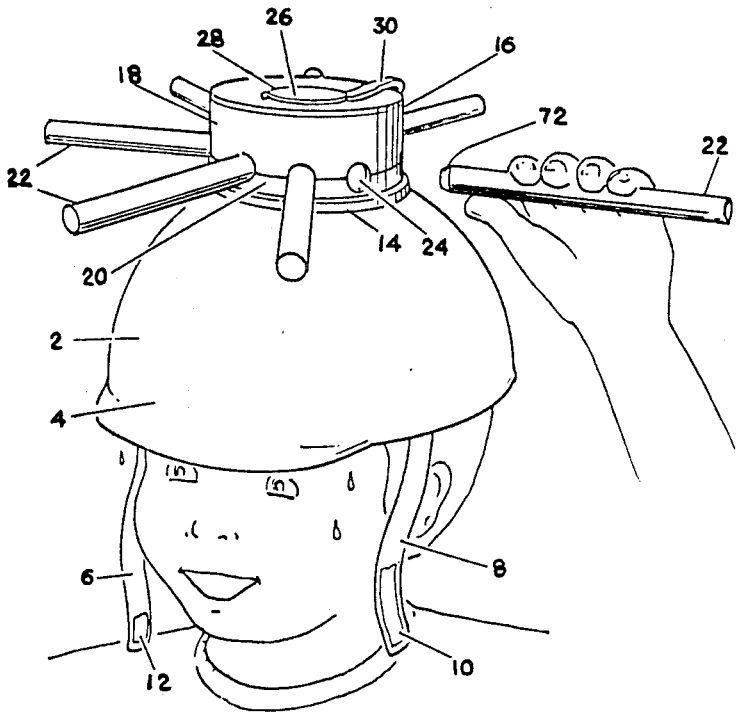
FIG. 1 illustrates the head piece of the invention on a wearer.

FIG. 1 illustrates the head piece of the invention, which comprises a hat 2 that is formed with a shell 4 that can be injection molded from high impact polystyrene or equivalent plastics, using conventional molding techniques. The hat supports, at its lower edge, straps 6 and 8 which can be riveted or similarly attached to the shell 4 to provide attachment means to secure the hat 2 around wearer's chin. These straps 6 and 8 can be formed of a flexible fabric, plastic such as vinyl and the like, and can have attachment means such as tabs 10 and 12 which are formed of the conventional Velcro attachment fabrics. These attachment fabrics have coating fabric members of hook and loop construction. The fabric tabs attach to each other by this conventional design of the fabric hook piece gripping into the fabric loop piece. For this purpose, Tab 12 can be of the hook design and Tab 10 can be of the opposite, loop design material.

Integrally molded in the top of hat 2 is a ring 14 which supports a container 16 that is formed of an upper, half container 18, and a lower half container 20 which is rotatably positioned within the ring 14. These members are shown in greater detail in FIG. 2.

A plurality of rods 22, preferably eight rods, are removably positioned, one each, in respective apertures 24 that are equally spaced about the perimeter of the container 16. A removable plug 26 provides a cover to a central aperture 28 in the top wall of the upper half container 18. This plug 26 can be secured or assembled to the unit with a strap 30 to prevent loss of the plug 26. Each of the rods 22 has a tapered end 72 to facilitate insertion of the rods into the apertures 24 of the hat.

Rods 22 and the upper half container 18 and lower half container 20 can also be formed by injection molding of plastics such as high impact polystyrene or high density polyethylene.

Figure 2:
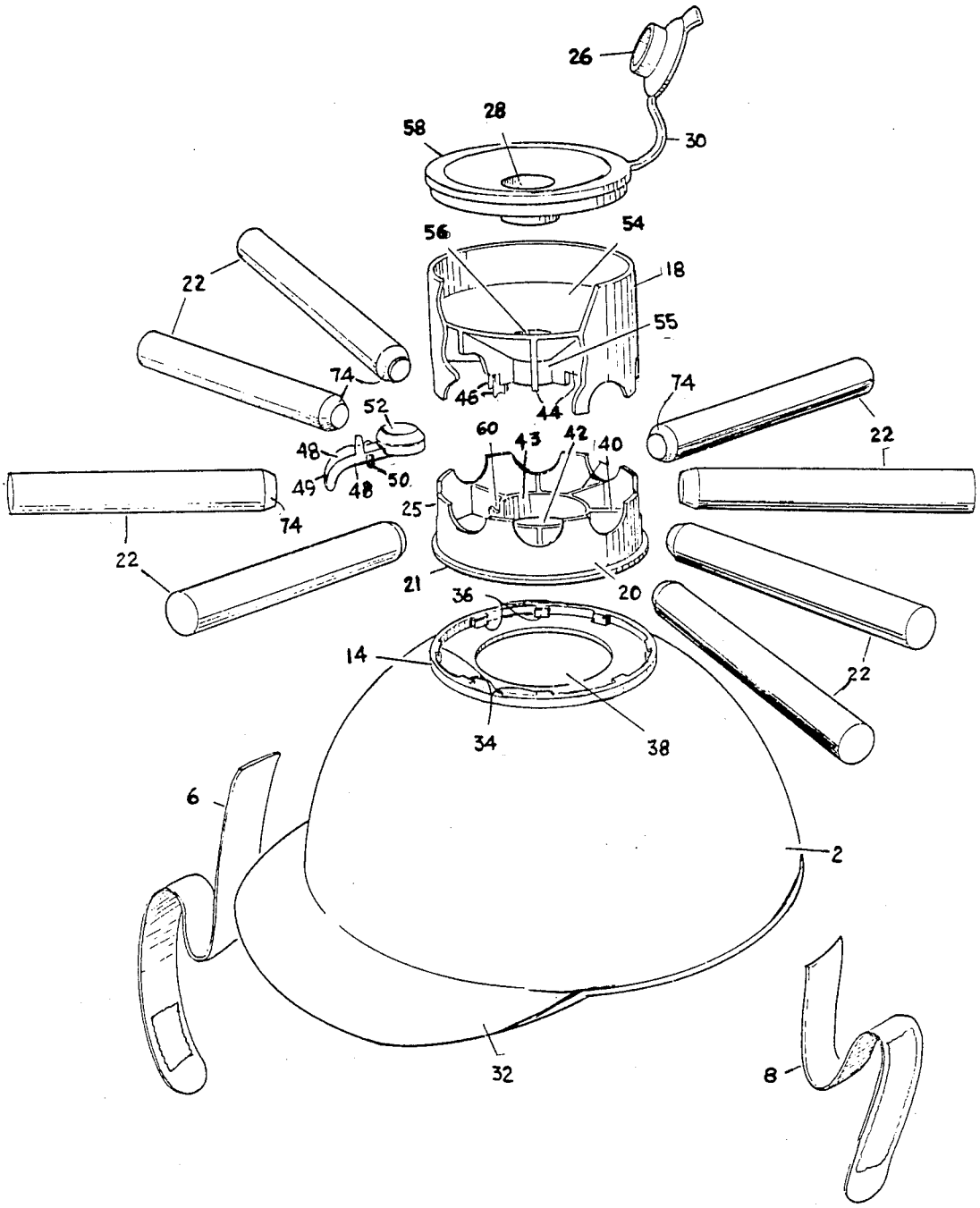
FIG. 2 illustrates an exploded parts drawing of the head piece.

Referring now to FIG. 2, there is illustrated an exploded perspective view of the hat 2 of the invention. The upper container 18 is shown in partial cutaway to clarify its internal design. In the drawing, hat 2 is shown in a preferred embodiment with an integral visor 32. The straps 6 and 8 are illustrated detached from the hat, however, these are permanently secured to the hat with fasteners such as rivets, previously described. The retainer ring 14 is integrally molded in the top apex of the hat 2. The retainer ring is provided with a plurality of tabs 34 which serve as detents to secure the lower container half 20. For this purpose, the container half 20 has an outer annular rim 21 which snaps beneath the tabs 34 thereby retaining the assembly while permitting free rotational movement of the lower container half 20 within ring 14. The tabs 34 are integrally molded with ring 14 and, to this end, shutoff holes 36 are located directly beneath each of the tabs 34 to provide access for the injection molding tooling during information of the tabs 34.

The upper end of hat 2 has a central open aperture 38 which, as described hereinafter, provides passage for the water which is in the bottom container to drain onto the wearer's head.

The lower half container 20 is molded with internal ribs 40 to provide stability for each of the rods 22 in the assembly. The lower half container 20 is also provided with a central aperture 42 which will provide free passage of water.

The lower container half 20 has a center ring 43 which is integral with the aforementioned ribs 40. This ring 43 has a slot in which is positioned a boss 60. The pivot rod 50 of lever 48 is mounted over boss 60 in the assembly.

The upper container half is permanently secured to the lower container half 20 by conventional attachment, e.g., solvent welding, cement bonding, and the like. The upper container half has a transverse partition 54 which can be conically shaped, as illustrated, to empty through a central aperture 56. The partition 54 is internally braced with ribs 44 that extend radially across the bottom of the partition 54 and have bottom edges which seat on the central ring 43 of the lower container half 20. A pair of inverted saddles depend downwardly from the bottom edge of the ribs 44 and these saddles provide for rotational support of pin 50 that projects laterally from the pivot lever 48. At its inner end, pivot lever 48 fixedly supports a closure 52 that seats against the open lower end of the central sleeve 55 of the upper container half 18. The closure member 52 can be formed of silicon or a similar flexible material, e.g., low density polyethylene to provide a water tight contact against the lower edge of the central sleeve 55.

The top cover plate 58 fits within the upper end of the upper half container 18. This plate can be formed of high density polyethylene or equivalent plastics, and can be permanently secured to the upper edge of the upper container half 18 by bonding, friction fit, etc. The central aperture 28 provides access for filling the container and plug 26 is removably seated in the aperture 28 to prevent water from splashing out of the container during play.

The lever 48 has an arcuately formed outer end 49 which extends into a position directly opposite one of the apertures, e.g., aperture 25. In this position, the rod which is inserted in this aperture has its inner end 74 into an abutting support of the fulcrum lever 48, thereby rotating the closure member 52 into closure against the bottom edge of sleeve 55.

Figure 3:
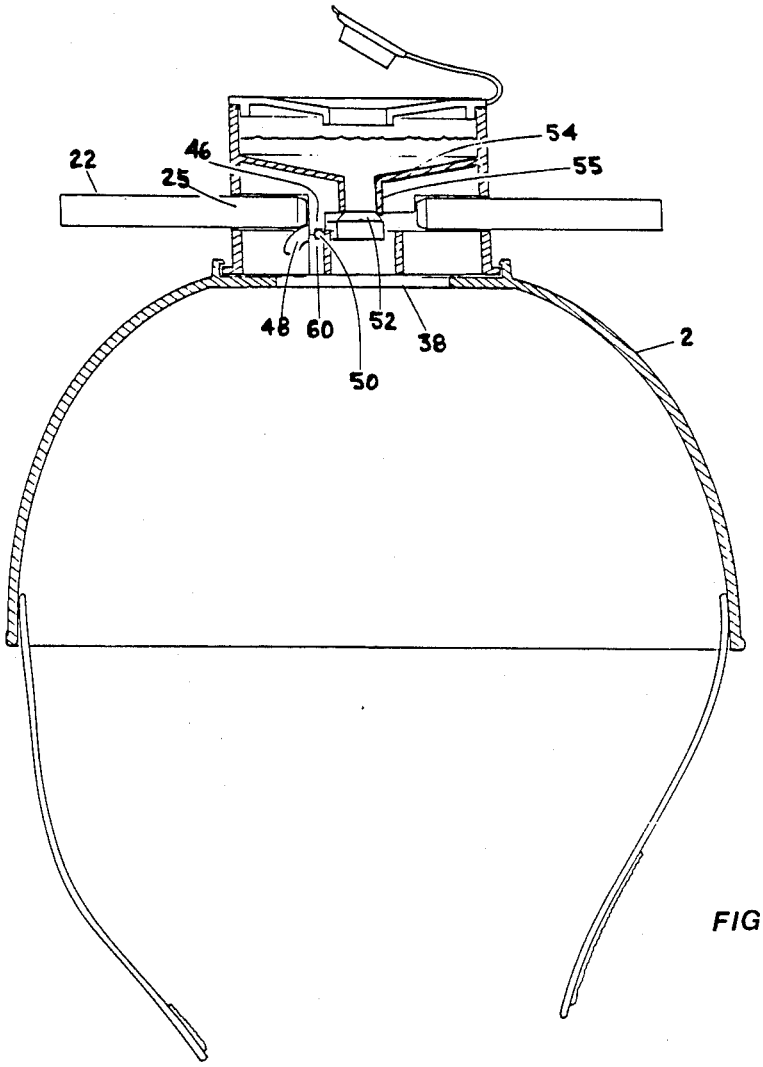
FIG. 3 illustrates the head piece in a cross-sectional view.

Referring now to FIG. 3 there is an elevational sectional view of the hat. The rod 22 is illustrated in its position through hole 25, into an abutting contact with the lever 48. The pivot rod 50 of the lever is rotationally secured between the upper inverted saddles 46 and the lower boss 60. The inner end of rod 22, bearing against lever 48, forces closure member 52 upwardly into closure of the lower end of the central sleeve 55 of the container, thereby functioning as a valve member, blocking water flow through the bottom aperture 55 of the partition 54.

When rod 22 is extracted from the assembly, i.e., from aperture 25, the lever 48 is released and the weight of the water on the valve member will force the valve open, discharging the water in the upper container downwardly through the central aperture 38 of hat 2 and onto the wearer's head.

Figure 4:
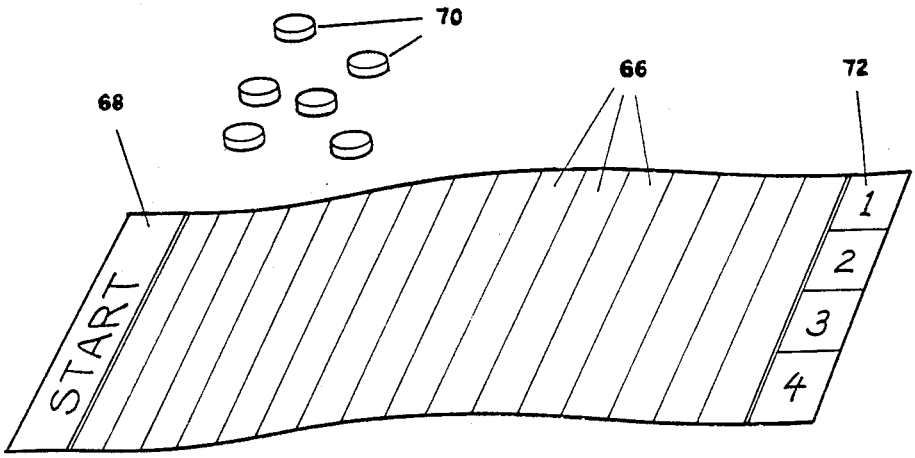
FIG. 4 illustrates a scoring mat and scoring tokens that can be used to tally each player's score in the game.

FIG. 4 illustrates a suitable scoring mat which can be formed of water proof silkscreen vinyl resins. The mat is divided into a number of spaces, typically shown as 66 with a starting line 68 where each player's colored token 70 is positioned. As the play progresses, each player will move his respective token 70 one space at a time until the winner's token first reaches the finish line 72.

The invention will be described with reference to the following example:

EXAMPLE

The game is illustrated by the following specific application. The game is intended for use by two to six players, age 8 to adult.

The object of the game is to obtain the highest score by removing the greatest number of rods 22 from the hat.

The equipment which is used for a game comprises the following:

1 hat
8 rods
1 score mat
6 score tokens

To start the game, the score mat 64 is placed on the ground a safe distance away from the players.

1. Each player takes a different colored score token 70 and places it on the start space 68 of the score mat 64.
2. The players take alternate turns wearing the hat 2.
3. All eight rods 22 are inserted, one each, into the eight holes 24 in the hat 2. The filler cap 26 is removed, and water 62 is poured into the liquid contaner 54 through the filler hold 28.
4. The first player places the hat on his head, and affixes the chin straps 6 and 8. He can now reach up and rotate the liquid container to any position and he then must remove one of the eight rods 22 from the hat 2. If water is released onto his head, he removes the hat. His turn is over and he moves his score token 70 one space on the score mat 64, because he removed one rod from the hat 2.

If no water was released when the first rod was removed, the player can then remove as many additional rods, one at a time, as he chooses. His turn is over as soon as the rod in hole 25, that releases the water, is removed. He moves his score token 70 one space for every rod removed; except that if he successfully removes seven rods without releasing the water, he moves his score token ten spaces on the score mat.

After the first player's turn is complete, either by his getting wet, or his decision to stop removing rods, or his successful removal of seven rods; then the hat is removed from his head and refilled with rods, and water if necessary. It is now the second player's turn.

After all players have played several roounds as described herein, the first player to move his score token across the finish line on the scoremat, wins An alternative gameplay can involve each player wearing the hat, removing only one rod, and then giving the hat with its remaining rods to the next player, who must remove one more rod before passing the hat to a subsequent player. The first player each round, to remove the rod that releases water, is eliminated from subsequent rounds of play. Play continues until only one player is left. He's the winner.

The invention has been described with reference to the illustrated and presently preferred embodiment. It is not intended that the invention be unduly limited by this disclosure of the presently preferred embodiment. Instead, it is intended that the invention be defined, by the means, and their obvious equivalents, set forth in the following claims:

I claim:

1. A game method for playing by a plurality of players, using a game device comprising a container to be worn by at least one of the players and having a plurality of receptacles isolated from said container and a through hole in fluid communication with said container which removably receive control members, which comprises the steps of:

a. selecting players;

b. placing a similar number of control members into said receptacles and said through hole in said device, whereby the one of which members in said through hole will prevent the flow of a liquid from the container of said device;

c. filling said container of said device with a liquid;

d. placing the device on a selected player;

e. selectively removing one member at a time, so as to control the release of the liquid; and f. keeping a score of the total of said control members successfully removed before removal of the control member in said through hole over a series of turns at play.

2. The method of claim 1 wherein the device is worn on a player's head.

3. The method of claim 1 wherein the device is a hat-like unit.

4. The method of claim 1 wherein players alternate turns wearing the device and removing one member at a time.

5. The method of claim 1 wherein score is kept on a game mat with a designated number of spaces upon which to move score tokens.

6. A game device comprising a housing and a container received within said housing and having a through aperture in one of its walls, a plurality of identical receptalces in an external wall of said housing, one of said receptacles being in fluid communication with said through aperture and the remaining ones of said receptacles being isolated from said container and said through hole, and a like number of control members one each received within a respective one of said receptacles, a valve member pivotally mounted within said housing with a lever arm extending into said one receptacle into bearing contact with the received end of a selected one of said control members, and supporting a valve closure on its opposite end which is pivotal between a closed position in engagement with said through aperture when the lever arm is in bearing contact with said selected control member and an opened position recessed from said through aperture when said selected control member is removed from said one receptacle.

7. The game device of claim 6 wherein said housing is received on a hat to be worn on the head of a game player.

8. The game device of claim 7 wherein said control members are rods which are removably received in said receptacles.

9. The game device of claim 6 wherein said housing is formed of upper and lower halves secured together along a joint line bisecting said receptacles.

10. The game device of claim 9 wherein said container is contained in the upper half of said housing.

11. The game device of claim 10 including an aperture in the top wall of said container with a removable closure member received in said aperture to provide access for filling said container.

12. A game device comprising a headgear supporting a housing formed by an external wall and adapted to be worn by one of several players of the game, a container of liquid supported in said housing, a plurality of receptacles spaced about said external wall of said headgear each being identical to the others in appearance externally of said headgear, a like plurality of control members, one each removably seated in a respective one of said receptacles, a fluid passageway within said housing and communicating between said container and only one receptacle of said receptacles, and fluid release means in said fluid passageway and coupled to the control member received in said one receptacle, whereby removal of said control member will cause release of liquid from said container.

13. The device of claim 12 wherein the control members are rods and the headgear is a hat.

14. The device of claim 5 wherein the housing is rotatably mounted on said headgear.

15. The device of claim 12 wherein said liquid release means is a valve member pivotally mounted in said housing between a position sealing said liquid passageway and removed from said liquid passageway and having a lever arm engaged by the inserted end of said one control member received in said one receptacle.

16. The device of claim 12 wherein said liquid relese means is a valve that is internally received in said housing and that is restrained by said one of said control members.

17. The device of claim 12 wherein said headgear is a hat and said receptacles are positioned whereby said one receptacle directs liquid discharged therefrom onto the head of a person wearing the headgear.

* * * * *